United States Patent [19]

Farmer

[11] 3,992,759

[45] Nov. 23, 1976

[54] BATTERY GRID PLATE MOLD AND METHOD

[75] Inventor: John Edgar Farmer, Chicago, Ill.

[73] Assignee: Farmer Mold and Machine Works, Inc., Chicago, Ill.

[22] Filed: Aug. 25, 1975

[21] Appl. No.: 607,289

[52] U.S. Cl. ..... 29/2; 249/60
[51] Int. Cl.[2] ..... B23P 13/00; B22C 9/26
[58] Field of Search ..... 29/2; 249/60

[56] References Cited

UNITED STATES PATENTS

| | | | |
|---|---|---|---|
| 1,368,445 | 2/1921 | Little | 249/60 |
| 1,809,289 | 6/1931 | Steckler | 29/2 |
| 1,927,384 | 9/1933 | Baver | 249/60 |

*Primary Examiner*—Harrison L. Hinson
*Attorney, Agent, or Firm*—Coffee and Sweeney

[57] ABSTRACT

A bottom gating mold system which is particularly adapted for molding relatively flat and generally elongated and/or wide metal objects such as battery plates or grids.

5 Claims, 2 Drawing Figures

BATTERY GRID PLATE MOLD AND METHOD

BACKGROUND OF THE INVENTION

1. Field of the Invention

This invention relates to the molding of metal objects such as battery plates or the like by a bottom gating process and especially to the efficient production of such objects while minimizing the trimming of flash and gate.

2. Brief Description of the Prior Art

After a study of applicant's own file preliminary to the filing of the present application, it is believed that the most relevant prior art is U.S. Pat. No. 1,809,289 patented June 9, 1931, which shows a mobile molten metal tank which is moved between stationary molds for producing battery grid plates by forcing the molten metal from the tank into the mold sections. However, as evidenced by the age of the prior art patent and the lack of real commercial usage of the bottom gating technique in the production of battery grid plates even to this date, the prior gating systems have had their disadvantages. One disadvantage is that it is extremely difficult to assure filling of the mold completely under the required pressurized conditions while still minimizing the formation of trim and flash. Often either incomplete grids are formed or else excessive trim and flash is formed.

In view of the difficulties with bottom gate molding, such molding generally has been used only for artistic or specialty items. Gravity flow top gate molding is normally used for such operations as the productions of battery grid plates.

SUMMARY OF THE INVENTION

I have found a new method and apparatus for making a battery grid plate in which the plate is fully formed while minimizing flash and gate and which eliminates the need for transporting tanks of molten lead or the like. In my system, I provide a pair of mating mold halves or portions defining a mold cavity for molding a battery grid plate and having a bottom slot as the bottom gate. A delivery head is maintained full of molten lead by means of a valved bottom molten lead inlet and has a top slot-like discharge nozzle. A fanning out distribution reservoir is provided between the inlet and the discharge nozzle so that the molten lead is distributed rather evenly along the length of the discharge slot. The top discharge slot is mated with the bottom gate of the mold and the valve is opened to supply molten metal under pressure through the head and gate to fill the mold cavity.

A cooling block is provided adjacent the delivery head and is usually insullated from the delivery head by a mass of insullation in direct contact with both the head and the block. Coolant is delivered through passages in the block. The filled mold is transferred from the head to the cooling block while breaking the sprue between the mold and head. The molded grid is quickly cooled and solidified and the mold is then transferred to an ejection station where the mold is opened for delivering the battery grid plate therefrom.

While this invention is susceptible of embodiment in many different forms, there is shown in the drawings and will herein be described in detail a specific embodiment in many different forms, there is shown in the drawings and will herein be described in detail a specific embodiment thereof with the understanding that the present disclosure is to be considered as an exemplification of the principles of the invention and is not intended to limit the invention to the embodiment illustrated.

DESCRIPTION OF THE PREFERRED EMBODIMENT

Figure 2:
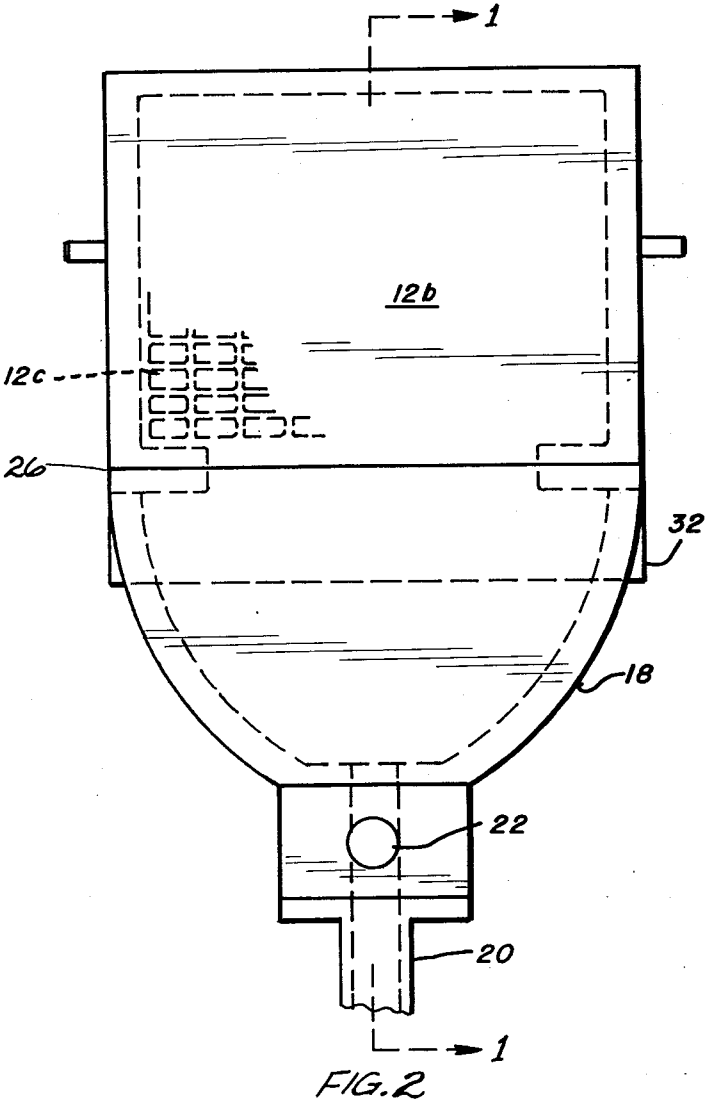
FIG. 2 is a side plan view taken from the left of FIG. 1.
Figure 1:
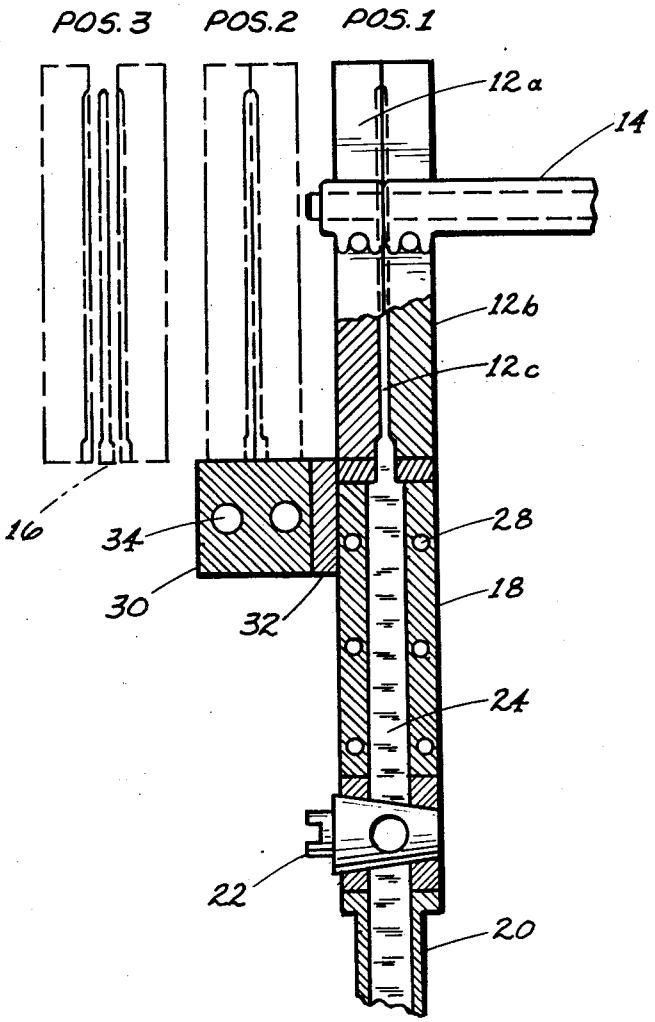
FIG. 1 illustrates the mold in three different positions in accordance with one form of the present invention, in position 1 showing the mold and molten metal delivery head in verticle section in position 2 showing the cooling block in section, and in position 3 demonstrating ejection.

As seen in FIGS. 1 and 2, a mold 12 is provided and consists of mating mold halves or sections 12*a* and 12*b* defining a mold cavity 12*c* therebetween when the mold is closed as best seen in position 1 of FIG. 1. The mold can be moved laterally and returned on a suitable mold carrier indicated schematically at 14. The mold cavity 12*c* is of suitable size and shape for producing a battery grid plate as at 16 as a result of the molding operation.

A bottom molten metal delivery system or a head is shown at 18. The head 18 has a heated inlet conduit 20 for delivering molten metal under pressure through the head 18. A siphon type molten metal delivery system such as that described in my U.S. Pat. No. 3,815,623 may be conveniently used. A stopcock valve is provided at 22 for controlling the delivery of molten metal through the head 18. The head 18 also includes a distributor or manifold reservoir 24 and a top slot-like elongated outlet or nozzle end 26 (FIG. 2).

The head 18 is also provided with heating electrodes as at 28 for maintaining the metal in reservoir 24 in heated and molten condition. It will be noted that the reservoir 24, as best seen in FIG. 2, fans out from its inlet end to its slot like outlet in order to generally equally distribute the molten metal along the length of the outlet for even flow into the mold cavity 12*c*.

Laterally adjacent the heated head 18, there is provided a cooling block 30 separated from head 18 by a mass of insulation 32 which is in direct contact with head 18 and the block 30. Passages 34 are provided in the block 30 for delivery of water or other coolant therethrough.

In the method of the present invention, the mold halves 12*a* and 12*b* are mated as seen in position 1 of FIG. 1 and are positioned, as by carriers 14, with the mold cavity inlet in direct sealed flow communication with the nozzle end 26 of head 18. Valve 22 is then turned to open position to inject molten lead into cavity 12*c* to fill the cavity. Valve 22 is then closed and the mold 12 is transferred to position 2, breaking the sprue between head 18 and mold 12 in the process. Coolant circulates through passages 34 and with the mold 12 resting in position 2 on the cooling block 30, cooling and solidification of the battery grid plate is rapidly accomplished. The mold 12 is then moved, e.g. by carriers 14, to position 3 where the mold sections are separated and the battery grid plate 16 is ejected. The operation is repeated as often as is necessary for production of the requisite number of plates 16. Of course, although only one head-mold-cooling block-ejection station combination is illustrated in the drawings, it will be understood that any number can be used at the same time for mass production purposes.

The system of the present invention simplifies the battery grid plate molding operation, minimizes the need for trimming flash and gate and utilizes a stationary molten metal delivery head using bottom gating principles to eliminate the need for transferring large tanks or vats of molten lead during the molding operation. Modifications of the system will be apparent to those skilled in the art.

I claim:

1. A method of producing grid-like battery plates which method comprises providing a pair of mating mold halves defining a mold cavity for molding the desired plate and having an elongated bottom slot as a bottom gate, providing a delivery head full of molten lead having a valved bottom inlet, a top slot-like discharge nozzle and a fanning-out distribution reservoir between said inlet and discharge nozzle, providing a source of molten metal under pressure connected to said inlet, mating said gate with said nozzle, controlling the flow of molten metal under pressure through said inlet to supply molten metal through said head and gate to fill said mold cavity and then terminate flow of molten metal, providing a cooling block adjacent to and laterally of said delivery head with a mass of insulation between said head and said block directly contacting both the head and the block, delivering coolant through said block, transferring the filled mold from said head laterally to said block while breaking the sprue between said head and said mold, cooling said mold and molded contents on said cooling block until the battery plate solidifies, transferring said mold laterally from said cooling block to an ejection station, and opening said mold at said ejection station for delivering the molded battery plate therefrom.

2. Apparatus for fabricating battery storage battery grid elements by pressurized molding at a casting station comprising means at the casting station defining a mold cavity formed between a plurality of mold elements which are joinable for receiving molten lead within the mold cavity, said cavity being formed in the shape defining a battery grid element, inlet means in the bottom of said mold cavity for injection of molten lead thereinto, means at said casting station defining a heated reservoir of molten lead having a top outlet releasably connected to the bottom inlet of said mold, stopcock valve means at the bottom of said molten lead reservoir at an inlet to said reservoir, means for supplying molten lead to said reservoir through said stopcock when said stopcock is in an open position, means for closing said stopcock upon introduction of molten metal into said reservoir and from said reservoir into said mold cavity in an amount sufficient to fill said mold cavity, means for delivering said mold to a second station, means at said second station for contacting said mold and cooling the molten metal to solidify the same, insulation means between said first and second stations, means for moving said mold to a third station upon solidification of said metal, and means at said third station for separating said mold elements and ejecting the resulting molded battery plate therefrom.

3. Apparatus for fabricating articles using a bottom gating process comprising a casting station having means defining a mold cavity formed between a plurality of mold elements which are joinable for receiving molten lead within the mold cavity, inlet means at the bottom of said mold cavity for injection of molten lead thereinto; stationary means defining a heated reservoir of molten lead having a top outlet releasably connectable to the bottom inlet of said mold, rotatable stopcock valve means at the bottom of said molten lead reservoir at an inlet to said reservoir for controlling flow of molten lead to said reservoir, means for supplying molten lead to said reservoir through said stopcock when said stopcock is in an open position, means for closing said stopcock upon introduction of molten metal into said reservoir and from said reservoir into said mold cavity in an amount sufficient to fill said mold cavity, a stationary cooling station and means for moving said mold cavity means from said heated reservoir to said cooling station.

4. Method for molding articles by pressurized molding at a casting station comprising means defining a mold cavity formed between a plurality of mold elements which are joinable for receiving molten lead within the mold cavity at the casting station, injecting molten lead from a heated reservior into said mold cavity by bottom gating, supplying molten lead to said reservoir through a stopcock with said stopcock in open position, closing said stopcock upon introduction of molten metal into said reservoir and from said reservoir into said mold cavity in an amount sufficient to fill said mold cavity, delivering said mold to a second station, cooling said mold and the molten metal at said second station to solidify the molten metal moving said mold to a third station upon solidification of said metal, and separating said mold elements at said third station and ejecting the resulting molded battery plate therefrom.

5. Apparatus for molding articles by pressurized molding at a casting station comprising means defining a mold cavity formed between a plurality of mold elements which are joinable for receiving molten lead within the mold cavity at the casting station, means for delivering molten lead into said mold cavity, a bottom gate at said mold cavity for receiving said molten lead therethrough, means for supplying molten lead to said reservoir including a stopcock movable between open and closed positions, said stopcock in open position permitting flow of molten lead to said reservoir and in a closed position stopping introduction of molten lead into said reservoir and from said reservoir into said mold cavity in an amount sufficient to fill said mold cavity, means for delivering said mold, upon filling, to a second station and thence to a third station, means at said second station for cooling said mold and the molten metal in the mold to solidify the molten metal, said mold elements being separable at said third station for ejecting the resulting molded battery plate therefrom.

* * * * *